US005514836A

United States Patent [19]

Delalle et al.

[11] Patent Number: 5,514,836

[45] Date of Patent: May 7, 1996

[54] ELECTRICAL CONNECTOR

[75] Inventors: Jacques Delalle, Triel-Sur-Seine; Alain Lamome, Pierrelaye, both of France

[73] Assignee: Raychem S.A., Cergy-Saint Christophe, France

[21] Appl. No.: 397,233

[22] PCT Filed: Oct. 11, 1993

[86] PCT No.: PCT/GB93/02093

§ 371 Date: Mar. 13, 1995

§ 102(e) Date: Mar. 13, 1995

[87] PCT Pub. No.: WO94/09531

PCT Pub. Date: Apr. 28, 1994

[30] Foreign Application Priority Data

Oct. 12, 1992 [GB] United Kingdom ..... 9221393

[51] Int. Cl.[6] ..... H01R 4/22; H01R 4/02; H01R 43/02

[52] U.S. Cl. ..... 174/87; 29/872; 174/74 R; 174/84 R; 174/DIG. 8

[58] Field of Search ..... 174/87, 138 F, 174/84 R, 74 R, DIG. 8; 29/868, 72

[56] References Cited

U.S. PATENT DOCUMENTS

| | | | |
|---|---|---|---|
| 3,010,745 | 11/1961 | Blomstrand et al. | 287/76 |
| 3,243,211 | 3/1966 | Wetmore | 287/78 |
| 3,525,799 | 8/1970 | Ellis | 174/84 R |
| 3,676,574 | 7/1972 | Johansson | 174/87 |
| 3,708,611 | 1/1973 | Dinger | 174/84 C |
| 3,814,139 | 6/1974 | Loyd et al. | 138/141 |
| 3,985,951 | 10/1976 | Harris | 174/138 F |
| 4,454,376 | 6/1984 | Holder et al. | 174/87 |
| 5,308,924 | 5/1994 | Lamome | 174/87 |
| 5,331,113 | 7/1994 | Soni et al. | 174/87 |
| 5,378,855 | 1/1995 | Delalle | 174/87 |
| 5,397,858 | 3/1995 | Delalle | 174/87 |
| 5,418,331 | 5/1995 | Delalle | 174/87 |

FOREIGN PATENT DOCUMENTS

| | | |
|---|---|---|
| WO 87/05447 | 9/1987 | WIPO . |
| WO 92/00616 | 1/1992 | WIPO . |
| WO 92/14278 | 8/1992 | WIPO . |

*Primary Examiner*—Morris H. Nimmo
*Attorney, Agent, or Firm*—Sheri M. Novack; Herbert G. Burkard

[57] ABSTRACT

A device for forming an electrical connection between a plurality of elongate electrical conductors comprises an electrically insulating sleeve, and contained within the sleeve a resiliently deformable tapering coil and a quantity of fusible polymeric material, the device being arranged so that the elongate electrical conductors may be connected by twisting them into the coil so that at least part of the coil is deformed and heating the device so that at least some of the fusible polymeric material melts and then, when solidified, substantially binds the coil in its deformed state.

15 Claims, 2 Drawing Sheets

ELECTRICAL CONNECTOR

This invention relates to electrical connectors for forming electrical connections between elongate conductors.

Simple electrical connectors which contain a screw thread, enabling wires and the like to be connected by screwing them into the connector are well known. Whilst these simple connectors provide a quick and easy method of producing an electrical connection, they often suffer from unreliability due to the connection not being secure; wires and the like often work loose over a period of time, due to strain on the connection. In addition, these types of connectors are often not sealed from the environment and this leads to corrosion. In order to overcome these problems, more sophisticated connectors have been proposed, such as for example the types of connectors described in international patent application No. WO 92/00616. These connectors contain, in addition to a screw thread connector, a quantity of solder which provides a permanent soldered connection once the connector has been heated for a sufficient period of time for the solder to melt. The connectors are also environmentally sealed by means of a heat recoverable sleeve which may additionally contain thermoplastic sealing rings. Whilst these connectors perform excellently, in order to form the solder connection they require a degree of heating which is either inappropriate or too time consuming for some applications.

According to one aspect of the present invention, there is provided a device for forming an electrical connection between a plurality of elongate electrical conductors, which comprises an electrically insulating sleeve, and contained within the sleeve a resiliently deformable tapering coil and a quantity of fusible polymeric material, the device being arranged so that the elongate electrical conductors may be connected by twisting them into the coil so that at least part of the coil is deformed and heating the device so that at least some of the fusible polymeric material melts and then, when solidified, substantially binds the coil in its deformed state.

According to another aspect of the invention, there is provided a method of forming an electrical connection between a plurality of elongate electrical conductors, which comprises:

(i) twisting one end of each elongate electrical conductor into a tapering coil of a device according to the invention so that at least part of the coil is deformed;

(ii) heating the device so that at least some of the fusible polymeric material melts; and (iii) allowing the device to cool so that the molten polymeric material solidifies and substantially binds the coil in its deformed state.

The device and method according to the invention generally enable the formation of reliable electrical connections since deformation of the tapering coil by twisting elongate electrical conductors into it normally causes the coil to grip the conductors due to its resilience. Because of this, the coil may be referred to as a 'gripping coil' or a connecting coil'. The coil may, for example, be deformed in this way by at least part of it being radially expanded. Alternatively or additionally the deformation may comprise axial extension of at least part of the coil. It is believed that substantially binding the coil in its deformed state by the solidification of the polymeric material normally causes the coil's grip on the elongate conductors to be maintained; it also normally renders the coil substantially rigid. These two effects appear generally substantially to prevent the elongate conductors working loose from the coil over a period of time and hence normally lead to reliable electrical connections.

According to one preferred embodiment of the invention, at least some of the fusible polymeric material that is contained within the sleeve of the device is located between the internal surface of the sleeve and the exterior of the coil. When, in use, the polymeric material is melted, at least some of the molten material normally flows and conforms to the exterior of the coil and therefore, when solidified, substantially binds the coil in its deformed state. The fusible polymeric material of this preferred embodiment of the invention may, for example, be in the form of an insert having any one of a variety of shapes, such as for example a ball, a pellet or a ring at least part of which surrounds at least part of the tapering coil. Where a ring of material is used, preferably it has a substantially frustoconical shape which generally conforms to the taper of the coil. More preferably, however, at least some of the fusible polymeric material has the form of a layer located on at least part of the internal surface of the sleeve. Most preferably, the layer is located on substantially the entire internal surface of the sleeve.

According to another preferred embodiment of the invention, the fusible polymeric material is located beyond an open end of the coil of the device. When, in use, the polymeric material is melted, at least some of the molten material normally flows into the interior of the coil and therefore, when solidified, substantially binds the coil in its deformed state. Preferably, the fusible polymeric material of this embodiment of the invention has the form of a ring, through which the elongate conductors may extend. When, in use, at least part of such a ring of fusible polymeric material is melted and subsequently solidifies, at least some of the material may help to seal the electrical connection from the environment.

The fusible polymeric material according to the invention preferably comprises a hot-melt adhesive. The material may, for example, be formed from an olefin homopolymer or from a copolymer of an olefin with other olefins or ethylenically unsaturated monomers. Preferred examples include high, medium or low density polyethylene or ethylene copolymers with alpha olefins, especially C3 to C8 alpha olefins, vinyl acetate or ethyl acrylate. Alternatively, the material may be formed from polyamides, polyesters, halogenated polymers and the like. Preferred polyamides include those having an average of at least 15 carbon atoms between amide linkages, for example those based on dimer acids and/or dimer diamines. Examples of such adhesives are given in U.S. Pat. Nos. 4,018,733 to Lopez et al and 4181775 to Corke, the disclosures of which are incorporated herein by reference. Particularly preferred polyamides are those which are sold under the trade name 'VERSALON' by General Mills Chemicals Inc. of Minneapolis, USA. Alternatively, the fusible polymeric material may comprise a thermoset material or composition. For example, the material may comprise one or more phenolic resins, amino resins, epoxy resins, or mixtures thereof, together with one or more curing agents, for example having reactive amine groups. It is preferred for the thermoset material to be in particulate form, for example as described in U.S. Pat. No. 4,896,904, the disclosure of which is incorporated herein by reference.

For some applications of the device according to the invention it is advantageous for the fusible polymeric material to have been blended with a quantity of metal particles, especially silver particles, thereby forming an electrically conductive composition. This may often be particularly advantageous for embodiments of the invention wherein at least some of the electrically conductive composition flows into the interior of the coil when the polymeric material is molten. Examples of suitable electrically conductive compositions include those described in International Patent Application, Publication No. WO91/06961, the disclosure of which is incorporated herein by reference.

The coil of the device according to the invention may be formed from any of a variety of materials, for example, the coil may be formed from a plastic material. Preferably, however, the coil is formed from metal, for example a substantially pure metal or a metal alloy. Preferred metals are steel, especially spring temper steel, and copper, especially hard temper copper.

The tapering coil of the device according to the invention is preferably formed from wire (metal wire or 'plastic wire'). The wire may generally have any cross-section which will allow a plurality of elongate electrical conductors to be connected by twisting them into the coil. Preferably, however, the cross-section of the wire is such that the wire has a ridge extending along its length which provides the coil with an internal screw thread. This has an advantage in that, where the hardness of the wire of the coil is greater than that of the elongate conductors, twisting the conductors into the coil in the same direction as the screw thread will normally result in the wires being screwed into the coil, due to the internal screw thread of the coil digging in to the elongate conductors. Most preferably the wire has a polygonal cross section, and in this case at least one of the angled portions of the cross section may form the ridge extending along the length of the wire.

The tapering coil and the fusible polymeric material of the device are contained within an electrically insulating sleeve. According to a particularly preferred embodiment of the invention, at least part of the sleeve is dimensionally heat-recoverable. A dimensionally heat-recoverable sleeve is an article which has a dimensional configuration which may be made substantially to change when subjected to heat treatment. Usually, such articles recover, on heating, towards an original shape from which they have previously been deformed, but the term 'heat-recoverable', as used herein, also includes articles which, on heating, adopt a new configuration, even if they have not previously been deformed.

The heat-recoverable sleeve may comprise a heat shrinkable article made from a polymeric material exhibiting the property of elastic or plastic memory as described, for example, in U.S. Pat. Nos. 2,027,962, 3,086,242 and 3,597,372. As is made clear in, for example, U.S. Pat. No. 2,027,962, the originally dimensionally heat-stable form may be a transient form in a continuous process in which, for example, an extruded tube is expanded, whilst hot, to a dimensionally heat-unstable form but, in other applications, a pre-formed dimensionally heat-stable article is deformed to a dimensionally heat-unstable form in a separate stage.

The sleeve is preferably formed from a polymeric material. Preferred materials include: low, medium or high density polyethylene; ethylene copolymers, e.g. with alpha olefins such a 1-butene or 1-hexene, or vinyl acetate; polyamides, especially Nylon materials, e.g. Nylon 6, Nylon 6.6, Nylon 11 or Nylon 12; and fluoropolymers, e.g. polytetrafluoroethylene, polyvinylidenefluoride, ethylene-tetrafluoroethylene copolymer or vinylidenefluoride tetrafluoroethylene copolymer.

For some applications, the device according to the invention may include a terminal portion, which preferably comprises a lug portion and a hollow shank. The terminal portion of the device may be connected to the tapering coil in any appropriate way; for example it may be soldered to the coil, the shank of the terminal portion may be crimped or crushed onto the coil, or the coil may be screwed into the shank of the terminal portion.

In the broadest aspect of the invention, the device includes a resiliently deformable tapering coil. The device may therefore include a single tapering coil so that a stub splice may be formed between a plurality of elongate conductors inserted into one end of the sleeve, the other end of the sleeve for example being closed, especially by means of a sealing ball as described in International Patent Application No, W091/11831, the disclosure of which is incorporated herein by reference, or by means of the end of the sleeve being flattened so that opposing portions of the sleeve are squashed together and held in this way by means of polymeric material fused between the opposing portions of the sleeve. Alternatively, however, the resiliently deformable coil may taper from two opposite directions to an intermediate region of minimum diameter. This form of device may therefore be used to form an in-line splice between a plurality of elongate electrical conductors. Another form of device according to the invention may also achieve this purpose: according to this embodiment, the device includes a second resiliently deformable tapering coil connected to the first tapering coil by connecting means. The connecting means may take any appropriate form, for example it may comprise a substantially cylindrical element which is provided with two or more protrusions or grooves which are capable of interlocking with the windings of the coils. The two coils may have the same or opposite handedness. It is also possible for the two coils to be rotatable with respect to each other.

Three forms of device according to the invention will now be described by way of example with reference to the accompanying drawings, in which:

FIG. 1 an isometric projection, partly in section, of a device according to the present invention;

Figure 1:
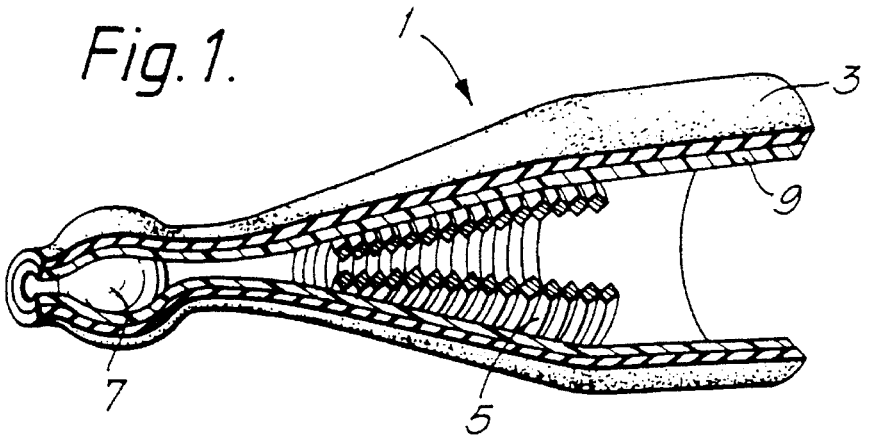

Referring to FIG. 1 of the accompanying drawings, a device 1 for forming an electrical connection between a plurality of elongate electrical conductors comprises a dimensionally heat-recoverable electrically insulating sleeve 3, formed from cross-linked Nylon 11 or Nylon 12, containing a resiliently deformable tapering coil 5 of hard temper copper wire of square cross-section and a sealing ball 7 formed from irradiated or non-irradiated polyethylene. The sleeve 3 has a layer of fusible polymeric material 9 located on its internal surface, the material comprising a polyamide hot-melt adhesive.

Figure 2:
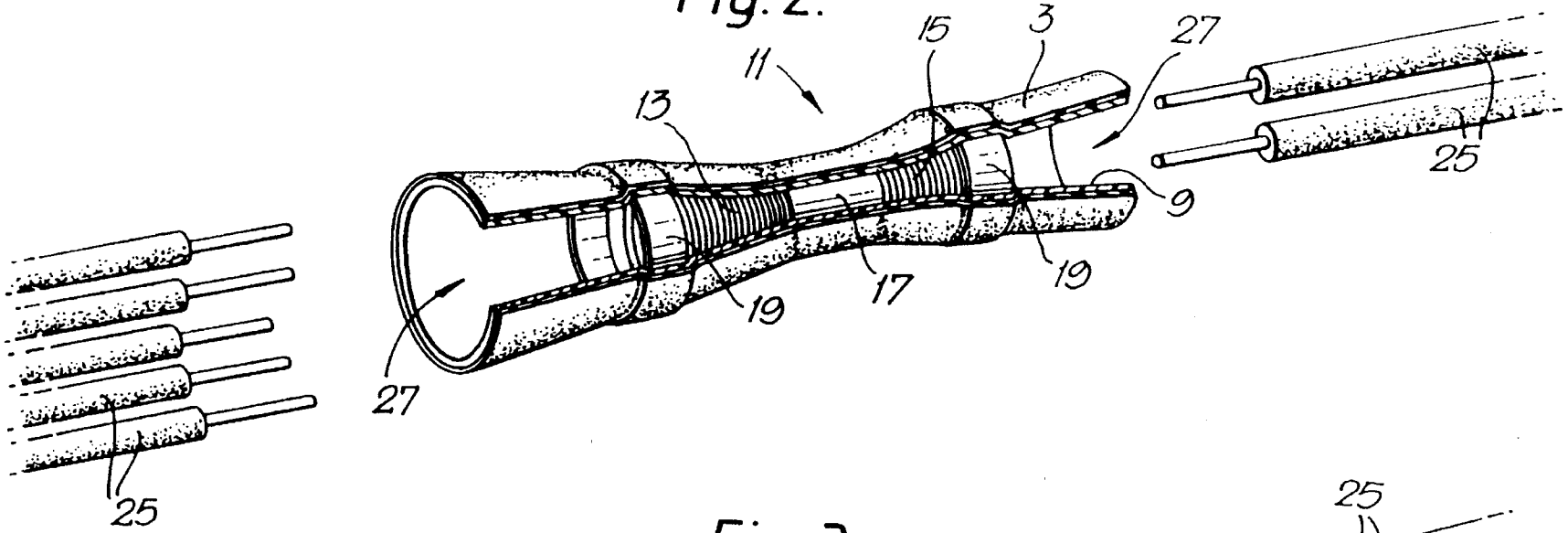
FIG. 2 is an isometric projection, partly in section, of a second form of device according to the invention and several insulated wires.

Referring now to FIG. 2, a second form of device 11 according to the invention comprises a dimensionally heat-recoverable sleeve 3 having a layer of fusible polymeric material 9 located on its internal surface, the sleeve containing a tapering coil 13 of hard temper square cross-section copper wire which is connected to a second tapering coil 15, also of hard temper square cross-section copper wire, by means of a substantially cylindrical copper connecting element 17. The sleeve 3 also contains two rings of fusible polymeric material 19, formed from polyamide hot-melt adhesive, each located beyond one of the open ends of the coils 13 and 15.

Figure 3:
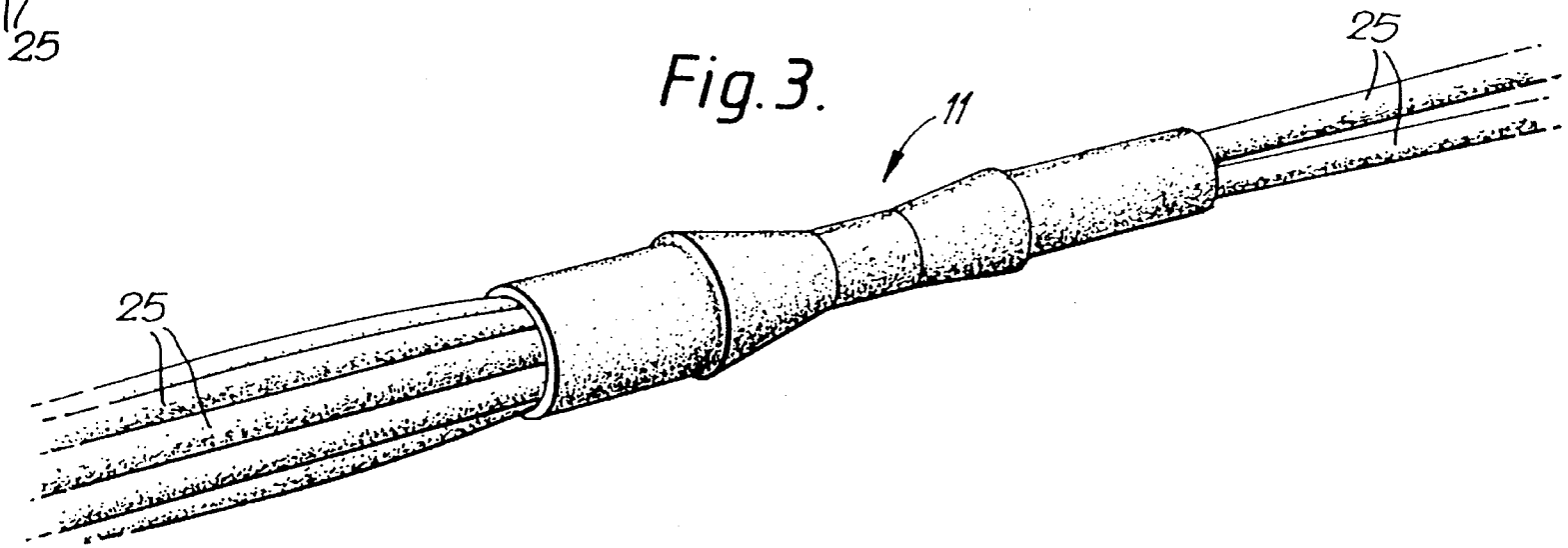
FIG. 3 is an isometric projection of an electrical connection between several insulated wires formed by means of the device shown in FIG. 2.

The device 11 may be used to form an in-line electrical splice between a plurality of insulated wires 25, as shown in FIG. 3. In order to form the splice, the ends of the wires 25 (each having an exposed length of conductor) are inserted into the device 11 through either open end 27 of the sleeve 3 and through the respective ring of fusible polymeric material 19 and twisted into the relevant tapering metallic coil 13 or 15. The two coils 13 and 15 have opposite handedness, so that the operator may either hold the device 11 stationary and twist the wires 25 into the coils or he may hold the wires stationary and twist the device onto them. The wires 25 are preferably twisted into each coil 13 or 15 in the same direction as the windings of the coil, so that they are effectively screwed into the device 11. Twisting the wires firmly into the coils will normally cause at least part of each coil to deform, for example by radial expansion and therefore grip the wires due to its resilience.

In order to bind the coils 13 and 15 in their deformed state and to seal the splice from the environment, the device 11 is heated, for example by means of an infra-red heater, a hot air gun, or a naked flame (a cigarette lighter may be used). Heating the device 11 causes the fusible polymeric material of the layer 9 and the rings 19 to melt and when cooled and solidified the material binds the coils in their deformed state. Heating the device 11 also causes the sleeve 3 to recover about the insulated wires 25, and this, together with at least some of the fused polymeric material of the rings 19, seals the splice from the environment.

Figure 4:
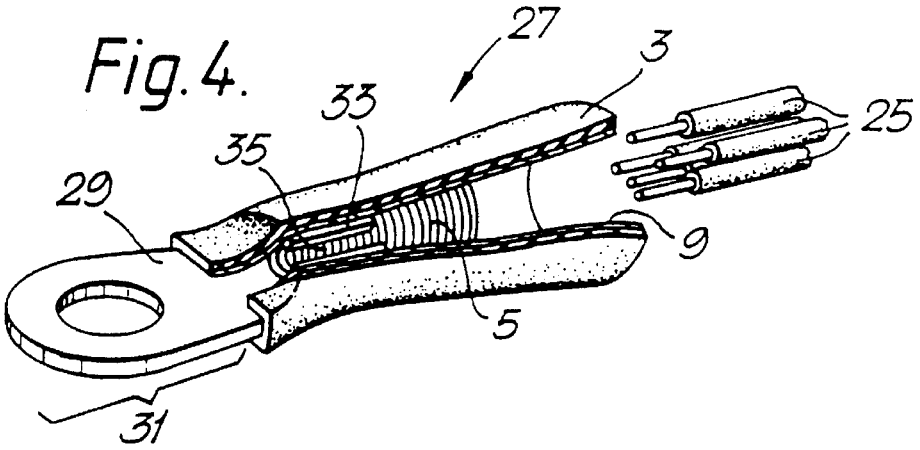
FIG. 4 is an isometric projection, partly in section, of a third form of device according to the invention, and several insulated wires.

FIG. 4 shows a device 27 according to the invention, which is similar to the device shown in FIG. 1, the only difference being that this device has a terminal portion 29 instead of a sealing ball 7. The terminal portion 29, which is formed from pressed copper or aluminium, comprises a lug portion 31 and a hollow shank 33. The shank 33 contains the relatively narrow end region 35 of the tapering copper coil 5.

Figure 5:
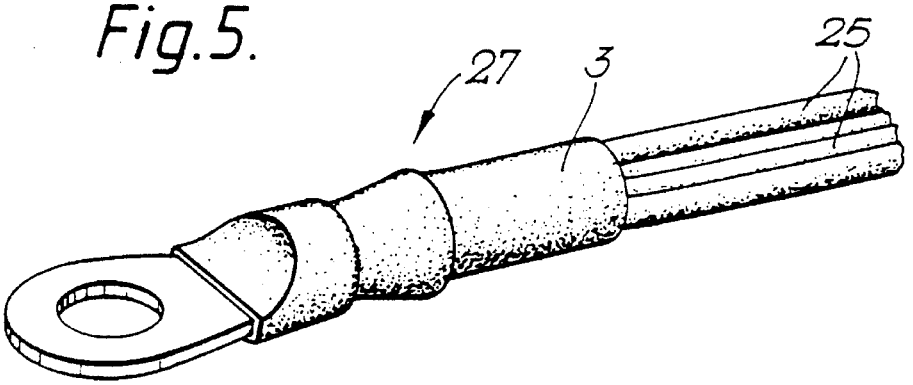
FIG. 5 is an isometric projection of an electrical connection between several insulated wires formed by means of the device shown in FIG. 4.

Also shown in FIG. 4 are several insulated wires 25, which are shown in FIG. 5 inserted into the device 27. Similarly to the splice of FIG. 3, the electrical connection shown in FIG. 5 has been formed by twisting the wires 25 into the tapering copper coil 5 and heating the device 27 in order to melt the fusible polymeric material 9 and to cause the sleeve 3 to recover about the wires.

We claim:

1. A device for forming an electrical connection between a plurality of elongate electrical conductors, which comprises an electrically insulating sleeve, and contained within the sleeve a resiliently deformable tapering coil and a quantity of fusible polymeric material, the device being arranged so that the elongate electrical conductors may be connected by twisting them into the coil so that at least part of the coil is deformed and heating the device so that at least some of the fusible polymeric material melts and then, when solidified, substantially binds the coil in its deformed state.

2. A device as claimed in claim 1, wherein at least some of the fusible polymeric material is located between the internal surface of the sleeve and the exterior of the coil.

3. A device as claimed in claim 1, wherein at least some of the fusible polymeric material has the form of a layer located on at least part of the internal surface of the sleeve.

4. A device as claimed in claim 1, wherein the fusible polymeric material is located beyond an open end of the coil.

5. A device as claimed in claim 1, wherein the fusible polymeric material comprises a hot-melt adhesive.

6. A device as claimed in claim 1, wherein the fusible polymeric material has been blended with a quantity of metal particles, thereby forming an electrically conductive composition.

7. A device as claimed in claim 1, wherein the coil is formed from metal.

8. A device as claimed in claim 1 wherein the coil is formed from a wire.

9. A device as claimed in claim 8, wherein the wire has a ridge extending along its length which provides the tapering coil with an internal screw thread.

10. A device as claimed in claim 9, wherein the wire has a polygonal cross-section.

11. A device as claimed in claim 1, wherein at least part of the sleeve is dimensionally heat-recoverable.

12. A device as claimed in claim 1, which includes a terminal portion comprising a lug portion and a hollow shank.

13. A device as claimed in claim 1, wherein the resiliently deformable coil tapers in two opposite directions to an intermediate region of minimum diameter.

14. A device as claimed in claim 1, which includes a second resiliently deformable tapering gripping coil connected to the first tapering coil by connecting means.

15. A method of forming an electrical connection between a plurality of elongate electrical conductors, which comprises:

(i) twisting one end of each elongate electrical conductor into a tapering coil of a device as claimed in claims 1 to 14, so that at least part of the coil is deformed;

(ii) heating the device so that at least some of the fusible polymeric material melts; and (iii) allowing the device to cool so that the molten polymeric material solidifies and substantially binds the coil in its deformed state.

* * * * *

UNITED STATES PATENT AND TRADEMARK OFFICE

CERTIFICATE OF CORRECTION

PATENT NO. : 5,514,836

INVENTOR(S) : Delalle et al.

DATED : May 7, 1996

It is certified that error appears in the above-identified patent and that said Letters Patent is hereby corrected as shown below:

Claim 15, line 5, insert --any one of-- after "claimed in".

Signed and Sealed this

Ninth Day of December, 1997

*Attest:*

Bruce Lehman

BRUCE LEHMAN

*Attesting Officer*

*Commissioner of Patents and Trademarks*